US012269664B2

(12) United States Patent
Mitchell et al.

(10) Patent No.: US 12,269,664 B2
(45) Date of Patent: Apr. 8, 2025

(54) CONTAINER ASSEMBLY WITH INTEGRATED FLUID REMOVAL

(71) Applicant: Shapiro Sales Company, St. Louis, MO (US)

(72) Inventors: Steven Mitchell, Ava, MO (US); Ron Fleetwood, Ava, MO (US); Michael Hadley, Seymour, MO (US); Ricky Alvarez, Columbia, IL (US)

(73) Assignee: SHAPIRO SALES COMPANY, St. Louis, MO (US)

( * ) Notice: Subject to any disclaimer, the term of this patent is extended or adjusted under 35 U.S.C. 154(b) by 138 days.

(21) Appl. No.: 18/176,590

(22) Filed: Mar. 1, 2023

(65) Prior Publication Data

US 2023/0278774 A1 Sep. 7, 2023

Related U.S. Application Data

(60) Provisional application No. 63/268,776, filed on Mar. 2, 2022.

(51) Int. Cl.
*B65D 81/26* (2006.01)

(52) U.S. Cl.
CPC ..... *B65D 81/262* (2013.01)

(58) Field of Classification Search
CPC ..... B65D 88/54; B65D 2231/008; B65D 88/747; B65D 81/261; B65D 81/262; Y10T 137/86348; B60K 2015/03473
See application file for complete search history.

(56) References Cited

FOREIGN PATENT DOCUMENTS

KR 101264071 B1 * 3/2011 ..... B09B 3/00

* cited by examiner

*Primary Examiner* — Anthony D Stashick
*Assistant Examiner* — L Kmet
(74) *Attorney, Agent, or Firm* — Philip S. Hof; The Small Patent Law Group LLC

(57) ABSTRACT

A container assembly includes a container, a flow channel, and a suction assembly. The container defines a cavity configured to receive a fluid therein. The container includes an interior surface along the cavity and an exterior surface outside of the cavity. The interior surface defines a lower hole, and the exterior surface defines an upper hole that is disposed closer than the lower hole to a top of the container. The flow channel extends from the lower hole to the upper hole and is disposed within a thickness of one or more wall sections of the container. The suction assembly is attached to the lower hole and fluidly connected to the flow channel. The suction assembly includes a strainer disposed within the cavity of the container for suctioning the fluid from the container.

20 Claims, 6 Drawing Sheets

CONTAINER ASSEMBLY WITH INTEGRATED FLUID REMOVAL

CROSS-REFERENCE TO RELATED APPLICATIONS

This application is a non-provisional conversion of, and claims priority to, U.S. Provisional Patent Application No. 63/268,776, filed Mar. 2, 2022, which is incorporated by reference in its entirety.

FIELD

The subject matter described herein relates to extracting fluid from containers.

BACKGROUND

Containers are often used to collect solid materials for temporary storage. The solid materials may be recyclable, such as scrap metal, and that can be transported to a recycling facility for processing. For example, a manufacturing facility may collect scrap metal from a manufacturing process in a container. The container may be transported to a recycling facility to sell the collected scrap material in return for a payment to the manufacturing facility. Containers may also collect fluids that are not part of the recyclable material (or other desired material that the container is intended to collect). For example, the container may have an open top that is exposed to the elements, such as precipitation. In another example, the container may collect process fluid that is utilized in the manufacturing process. It may be desirable to remove the fluid from the container while the container is at least partially filled with a solid material, such as scrap metal, to substantially isolate the solid material within the container.

BRIEF DESCRIPTION

In one or more embodiments, a container assembly is provided that includes a container, a flow channel, and a suction assembly. The container defines a cavity configured to receive a fluid therein. The container includes an interior surface along the cavity and an exterior surface outside of the cavity. The interior surface defines a lower hole, and the exterior surface defines an upper hole that is disposed closer than the lower hole to a top of the container. The flow channel extends from the lower hole to the upper hole and is disposed within a thickness of one or more wall sections of the container. The suction assembly is attached to the lower hole and fluidly connected to the flow channel. The suction assembly includes a strainer disposed within the cavity of the container for suctioning the fluid from the container.

In one or more embodiments, a method for assembling a container assembly is provided. The method includes forming a lower hole through an interior surface of a container. The interior surface at least partially defines a cavity of the container configured to receive a fluid therein. The method includes forming an upper hole through an exterior surface of the container outside of the cavity. The upper hole is disposed closer than the lower hole to a top of the container. The method includes providing a flow channel that extends from the lower hole to the upper hole and is disposed within a thickness of a wall section of the container, and attaching a suction assembly to the lower hole. The suction assembly is fluidly connected to the flow channel and includes a strainer disposed within the cavity of the container for suctioning the fluid from the container.

In one or more embodiments, a container assembly is provided that includes a container, one or more hollow pipes, and a suction assembly. The container defines a cavity configured to receive a fluid therein. The container includes a wall section that has an inner panel along the cavity and an outer panel outside of the cavity. The inner panel is spaced apart from the outer panel to define an internal compartment within a thickness of the wall section. The inner panel defines a lower hole therethrough, and the exterior surface defines an upper hole therethrough. The upper hole is disposed closer than the lower hole to a top of the container. The one or more hollow pipes are disposed within the internal compartment of the wall section, and define a flow channel from the lower hole to the upper hole. The suction assembly is attached to the lower hole and is fluidly connected to the one or more hollow pipes. The suction assembly includes a strainer disposed within the cavity of the container for suctioning the fluid from the container.

BRIEF DESCRIPTION OF THE DRAWINGS

The inventive subject matter described herein will be better understood from reading the following description of non-limiting embodiments, with reference to the attached drawings, wherein below.

DETAILED DESCRIPTION

The embodiments described herein relate to a container assembly that has an integrated fluid removal system. The container assembly suctions fluid from a cavity of the container to remove the fluid from the cavity. Removing the fluid provides several benefits, such as reducing the weight of the container assembly for ease of transport, isolating the solid material collected within the cavity for recycling or the like, and enabling accurate weight measurement of the solid material within the cavity. The components of the fluid removal system are integrated within the container. The fluid removal system may be affixed to the container in an operable configuration, such that the container system does not require an operator to hold and manipulate a suction assembly. The fluid removal operation may be initiated by an operator actuating a switch or providing a command to a computing device that is communicatively connected to the fluid removal system. Optionally, the fluid removal system may be at least partially automated such that a controller of the fluid removal system automatically initiates the fluid removal operation upon detection of a triggering event. The triggering event may be a fluid content within the cavity meeting or exceeding a threshold amount, or the like.

The components of the fluid removal system are integrated within the container in a way that reduces the risk of damage to the components. A majority of the hardware of the fluid removal system is disposed outside of the cavity. In an embodiment, only a suction strainer, a nominal length of pipe, and a bulkhead fitting is within the cavity. The cavity may receive heavy, sharp, corrosive, and/or abrasive solid materials therein, such as metal scrap material and other excess materials from manufacturing processes. Limiting the amount of the fluid removal system that is within the cavity reduces the risk of damage to the fluid removal system components from the solid materials. Another benefit of integrating the fluid removal components into the container is avoidance of manually inserting a wand attached to a suction strainer into the container. The solid materials in the cavity may obstruct access of the wand to the fluid at the bottom of the cavity. Another benefit of incorporating a majority of the fluid removal components outside of the cavity is that almost all of the volume of the cavity is available for receiving and holding the solid materials. The fluid removal components that extend into the cavity only occupy a nominal amount of space, optimizing the storage capacity of the container.

Figure 1:
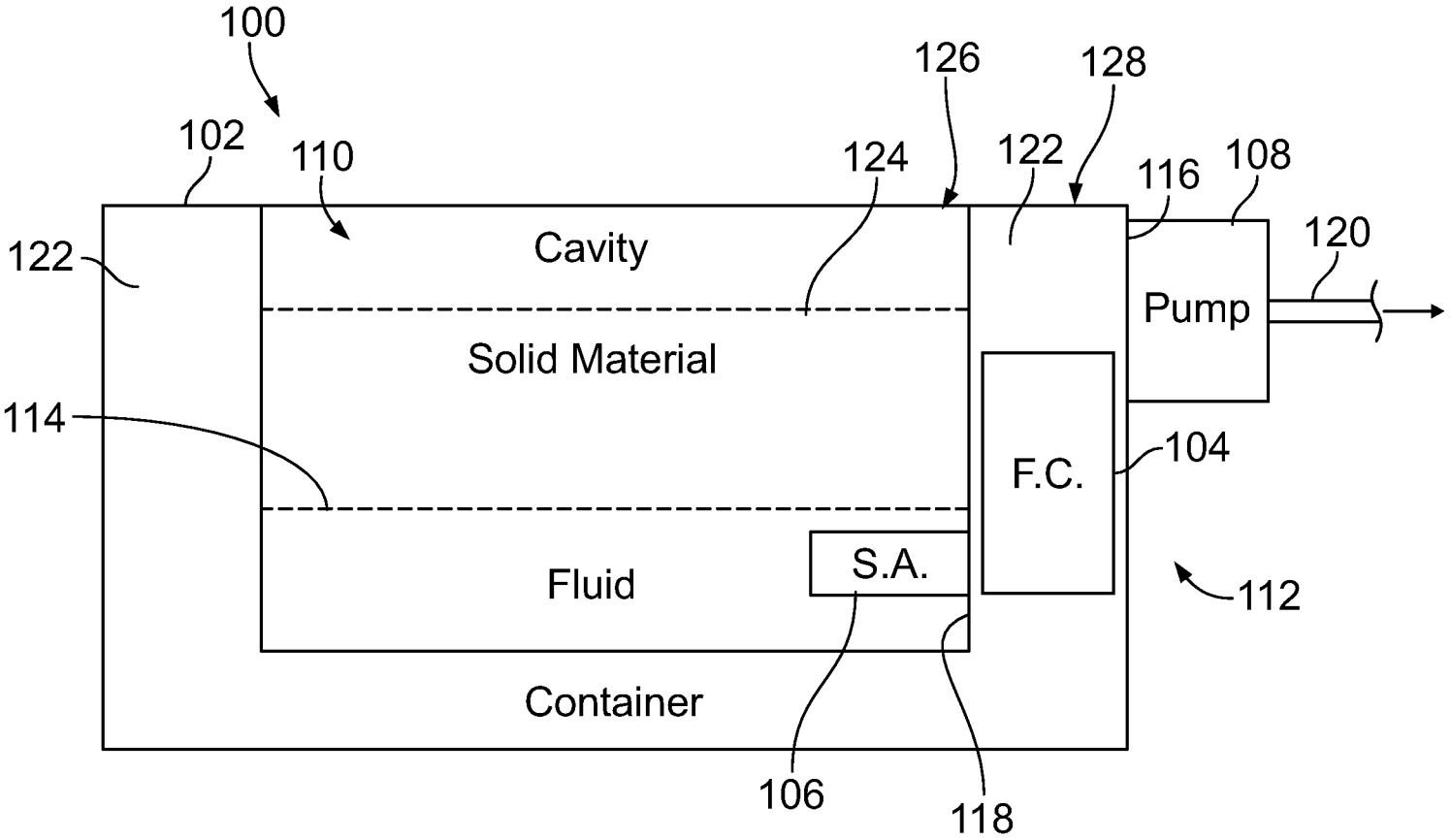
FIG. 1 schematic illustration of a container assembly according to an embodiment.

FIG. 1 is a schematic illustration of a container assembly 100 according to an embodiment. The container assembly 100 includes at least a container 102, a flow channel 104, and a suction assembly 106. The container 102 defines a cavity 110 for receiving and containing material. The material that is collected into the container cavity 110 depends on the application. Suitable materials may include waste materials from manufacturing processes, recyclable materials, manufactured products/objects, raw material, and/or the like. The flow channel 104 and the suction assembly 106 are integrated with the container 102. For example, the flow channel 104 and the suction assembly 106 are at least partially integrated into the structure of the container 102, rather than merely inserted into the cavity 110 and/or temporarily coupled to a wall of the container 102. The container assembly 100 may also include a pump device 108. The pump device 108 may be removably coupled to the container 102.

The suction assembly 106, the flow channel 104, and the pump device 108 represent components of a fluid removal system 112. The fluid removable system 112 is operable to extract fluid 114 from the cavity 110. The suction assembly 106 extends into the cavity 110. The suction assembly 106 is mounted to an interior surface 118 of the container 102 that defines at least a portion of the cavity 102. The pump device 108 is outside of the cavity 110. For example, the pump device 108 may be coupled to the container 102 to extend along an exterior surface 116 of the container 102. The flow channel 104 is fluidly connected to each of the suction assembly 106 and the pump device 108. For example, the flow channel 104 extends from the suction assembly 106 to the pump device 108. In an embodiment, the flow channel 104 is integrated with one or more wall sections 122 of the container 102, such that the flow channel 104 is within a thickness of the one or more wall sections 122. The thickness of the wall section(s) 122 may extend from the interior surface 118 to the exterior surface 116. For example, the interior surface 118 of the wall section(s) 122 may define at least a portion of the cavity 110, and the exterior surface 116 of the wall section(s) 122 may be along an exterior of the container 102. In one embodiment, the flow channel 104 is defined by one or more pipes discrete from the material of the container 102 and disposed within a compartment or pocket defined within a thickness of the wall section(s) 122. In another embodiment, the flow channel 104 is a shaped and formed void within the thickness of the wall section(s) 122 such that the flow channel 104 is defined by the material of the container 102 itself.

During operation of the fluid removal system 112, the pump device 108 produces a negative pressure which causes the suction assembly 106 to draw the fluid 114 from the cavity 110. The fluid 114 flows through the suction assembly 106 and the flow channel 104 to the pump device 108. The extracted fluid 114 is then pumped through an outlet pipe 120 to a drain, another container, or the like. The fluid removal system 112 is arranged to remove at least a substantial majority of the liquid fluid 114 that accumulates within the cavity 110 to isolate a solid material 124 that is within the cavity 110. The solid material 124 may be a scrap metal, solid or semi-solid waste, raw solid material (e.g., a powder, lumber, pellets, etc.), or the like. In an embodiment, the container 102 defines an opening 126 to the cavity 110 at a top 128 of the container 102. The solid material 124 and the fluid 114 are received into the cavity 110 through the opening 126. The fluid removal system 112 extracts the fluid 114 such that the solid phase material 124 represents a substantial majority (e.g., at least 90% or at least 95%) of the material present in the cavity 110.

A size and shape of the container 102 may be selected based on a particular application. For example, the container 102 may be longer than ten feet (e.g., longer than three meters) in length in one example application, and may be shorter than ten feet in length in another example application. The container 102 may be constructed of plastic, metal, a composite layered structure, or the like. In one embodiment, the container 102 is a plastic tote for receiving waste material and/or recyclable material into the cavity 110. The waste material and/or recyclable material may stem from an industrial process.

In one example use application, the container assembly 100 is stored, at least temporarily, at a client facility for the client to deposit recyclable material into the container 102. The container 102 may collect fluid 114 in addition to the solid recyclable material 124. The fluid removal system 112 may be selectively operated to extract fluid 114 from the cavity 110. For example, the fluid removal system 112 may operate on demand under control of a human operator, automatically based on a set schedule, and/or automatically in response to a triggering event, such as detection of at least a threshold amount of fluid 114 in the cavity 110. Eventually, the container assembly 100 is picked up from the client facility and transported to another location for handling and processing the recyclable material 124. In an embodiment, the pump device 108 may be disconnected and removed from the container 102 prior to transporting the container assembly 100 off-site. The flow channel 104 and the suction assembly 106 are integrated into the container 102, and are not removed prior to transport away from the client facility. In an alternative embodiment, the pump device 108 may remain mounted to the container 102 during the transport.

Figure 2:
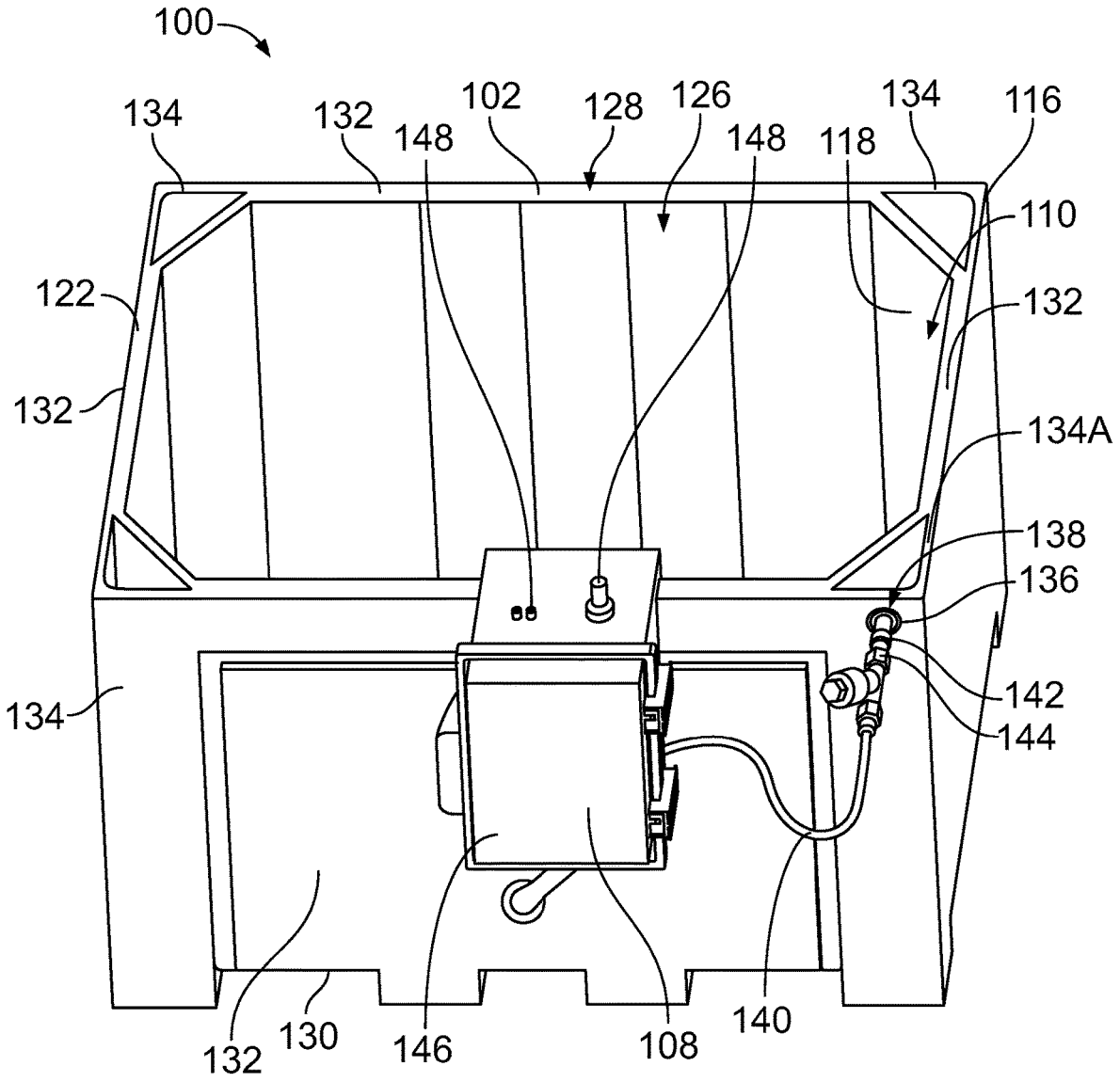
FIG. 2 is a perspective view of the container assembly according to an embodiment.

FIG. 2 is a perspective view of the container assembly 100 according to an embodiment. The container 100 has a generally box-shaped structure in the illustrated example. The one or more wall sections 122 include a bottom wall 130, multiple side walls 132, and multiple corner sections 134. The side walls 132 and corner sections 134 extend upward from the bottom wall 130. The corner sections 134 connect the side walls 132 together. The container 102 has four side walls 132 and four corner sections 134 in the illustrated embodiment. Each corner section 134 is at the interface between a corresponding set of two side walls 132. The top 128 of the container 102 is open to define the opening 126 to the cavity 110. The cavity 110 is empty in FIG. 2. In an alternative embodiment, the container 100 and/or the cavity 110 may have a shape other than box-shaped, such as cylindrical.

The corner sections 134 in FIG. 2 each have a linear interior surface 118 along the cavity 110 and a curved exterior surface 116 along the exterior of the container 102. The curved exterior surface 116 may define an approximate right angle between two segments of the curved exterior surface 116. As a result, the corner sections 134 may have generally triangular cross-sectional shapes, with the interior surface 118 representing one segment of the triangle and the curved exterior surface 116 representing two segments of the triangle. The corner sections 134 may have a non-triangular cross-sectional shape in other embodiments. For example, the cross-sectional shape of the corner sections 134 may be generally rectangular (e.g., square), circular, or the like.

In an embodiment, the flow channel 104 (shown in FIG. 1) is located within a first corner section 134A of the corner sections 134. The exterior surface 116 of the corner section 134A defines an upper hole 138. The flow channel 104 within the corner section 134A is fluidly connected to the upper hole 138. The container assembly 100 may include a first bulkhead fitting 136 mounted to the upper hole 138. The bulkhead fitting 136 may be sealed to the upper hole 138 via an adhesive, a sealant, a gasket, or the like. A portion of the bulkhead fitting 136 may project outward beyond the exterior surface 116.

The pump device 108 may be mounted to the container 102 along the exterior of the container 102. Optionally, the pump device 108 may have a hanger that hooks onto the top 128 of one of the side walls 132 to hang the pump device 108 on the container 102. In another example, the pump device 108 may latch or clip into a bracket secured onto the exterior surface 118 of the side wall 132 to mount the pump device 108. The pump device 108 may be located relatively proximate to the bulkhead fitting 136. A hose 140 is connected between the bulkhead fitting 136 and the pump device 108. The hose 140 defines a flow passageway from the bulkhead fitting 136 to the pump device 108.

In an embodiment, the hose 140 is removably connected to the bulkhead fitting 136 via a pair of connectors. The connectors include a first (e.g., header) connector 142 that is affixed to the bulkhead fitting 136. An end of the hose 140 is secured to a second (e.g., mating) connector 144. The mating connector 144 has complementary connecting features as the header connector 142 that interlock to selectively secure the hose 140 to the bulkhead fitting 136 of the container assembly 100. In an embodiment, the connectors 142, 144 are cam lock connectors that include manual locking features for mechanically securing the connectors 142, 144 in the mated configuration.

The mating connector 144 can be selectively uncoupled from the header connector 142 to disconnect the hose 140 from the container assembly 100. The opposite end of the hose 140 is connected to the pump device 108. When the connectors 142, 144 are coupled together, a flow path is established that extends from the pump device 108 through the hose 140, the flow channel 104 (shown in FIG. 1), and the suction assembly 106 (FIG. 1) into the cavity 110. The pump device 108 is operable to extract fluid from the cavity 110 along the flow path. The flow path continues along the outlet pipe 120 (shown in FIG. 1), which is not shown in FIG. 2.

The pump device 108 includes a housing 146 and multiple components within the housing including a pump motor, a power source and/or power converter, electronic control circuitry, and the like. The pump device 108 may include one or more physical user input objects 148, such as buttons, toggles, switches, and/or the like, exposed along an exterior of the housing 146 to enable manual control of the pump device 108. The pump device 108 optionally includes a display device (not shown) on the housing 146 for providing information to a human operator. In an embodiment, the pump device 108 may include a controller with processing circuitry for automatically controlling the pump device 108 based on input from one or more sensors. The controller may automatically activate the pump device 108, deactivate the pump device 108, select and/or modify an operating level or mode of the pump device 108, and/or the like. Optionally, the controller may perform analysis on the fluid 114 that is pumped from the container 102. The controller may control operations of the fluid removal system 112 based on the analysis of the fluid 114.

Figure 3:
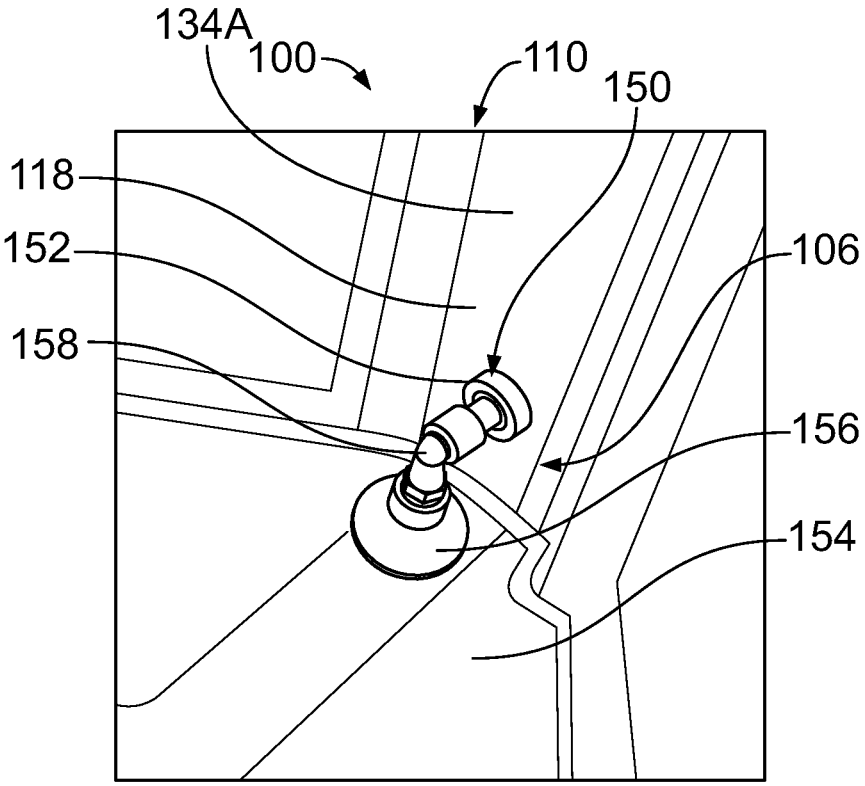
FIG. 3 is a perspective view of a portion of the container assembly showing a suction assembly within a cavity according to an embodiment.

FIG. 3 is a perspective view of a portion of the container assembly 100 showing the suction assembly 106 within the cavity 110. The suction assembly 106 is mounted to a lower hole 150 that is defined through the interior surface 118 of the corner section 134A. The flow channel 104 (shown in FIG. 1) within the corner section 134A is fluidly connected to the lower hole 150. The container assembly 100 may include a second bulkhead fitting 152 mounted to the lower hole 150. The bulkhead fitting 152 may be sealed to the lower hole 150 via an adhesive, a sealant, a gasket, or the like. A portion of the bulkhead fitting 152 may project beyond the interior surface 118 into the cavity 110. The lower hole 150 is proximate to a bottom surface 154 of the container 102 that defines a lower surface or bottom of the cavity 110, although the lower hole 150 is spaced apart from, and above, the bottom surface 154.

The suction assembly 106 includes a strainer 156 and a segment of hollow pipe 158 connecting the strainer 156 to the bulkhead fitting 152 at the lower hole 150. For example, the pipe segment 158 may have a proximal end affixed to the bulkhead fitting 152, and may extend in a direction towards a center of the cavity 110. The strainer 156 may be coupled to a distal end of the pipe segment 158. The strainer 156 may be oriented to extend downward toward the bottom surface 154. In an embodiment, the strainer 156 is suspended by the pipe segment 158 above the bottom surface 154 without contacting the bottom surface 154. Alternatively, the strainer 156 may rest on the bottom surface 154. The strainer 156 is a suction strainer that has small ports through which liquid is suctioned into the strainer 156. The ports are too small to accommodate some solid material. When the pump device 108 is operating, liquid and tiny solid particles may be suctioned through the ports of the strainer 156 and removed from the cavity 110. The extracted fluid and tiny particles flow through the lower hole 150, the flow channel 104, and the hose 140 to the pump device 108.

Figure 4:
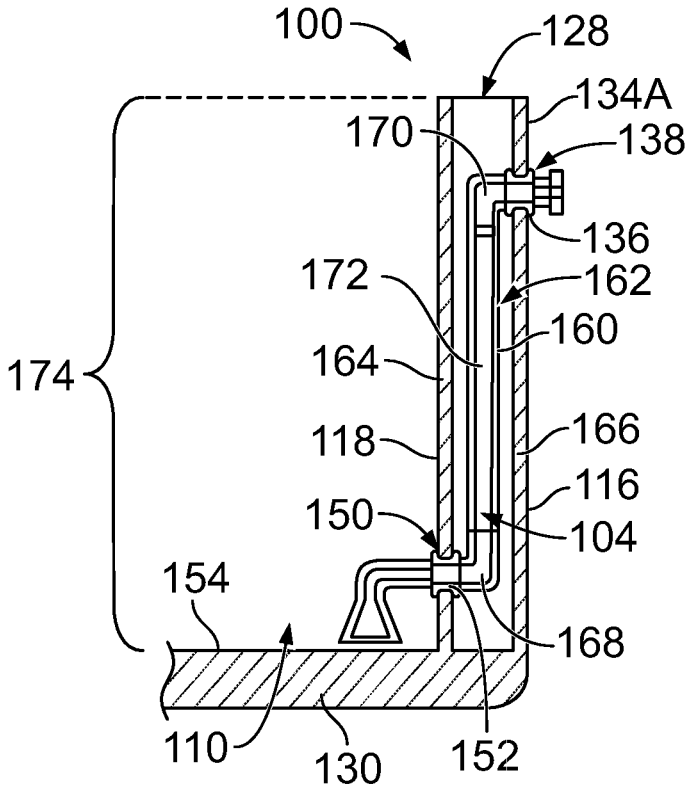
FIG. 4 is a cross-sectional view of a portion of the container assembly according to an embodiment.

FIG. 4 is a cross-sectional view of a portion of the container assembly 100 according to an embodiment. The illustrated portion shows the corner section 134A and part of the bottom wall 130 of the container 102. In the illustrated embodiment, the flow channel 104 is defined by one or more hollow pipes 160. The hollow pipes 160 may be constructed of a polymer material, such as polyvinyl chloride (PVC), a metal material, or the like. The hollow pipes 160 are disposed within an internal compartment 162 of the corner section 134A. The internal compartment 162 is a void or space that is discrete from the cavity 110 and the external environment. For example, the corner section 134A may include an inner panel 164 and an outer panel 166. The inner panel 164 is spaced apart from the outer panel 166 to define the internal compartment 162 therebetween. The inner panel 164 may include the interior surface 118 along the cavity 110. The lower hole 150 extends through the inner panel 164. The outer panel 166 may include the exterior surface 116. The upper hole 138 extends through the outer panel 166.

In an embodiment, the one or more hollow pipes 160 of the flow channel 104 include a first elbow joint 168, a second elbow joint 170, and a linear pipe 172. The first elbow joint 168 is connected to the bulkhead fitting 152 at the lower hole 150. The second elbow joint 170 is connected to the bulkhead fitting 136 at the upper hole 138. The linear pipe 172 is connected to each of the elbow joints 168, 170. The linear pipe 172 extends from the first elbow joint 168 within the compartment 162 to the second elbow joint 170 to fluidly connect the elbow joints 168, 170. The elbow joints 168, 170 may be angled at approximately right angles (e.g., within +/−5 degrees of 90 degrees). The hollow pipes 168, 170, 172 are installed within the internal compartment 162 during the assembly of the container assembly 100. In an alternative embodiment, a hose represents the one or more hollow pipes 160. For example, a single hose may connect to both the bulkhead fitting 152 and the bulkhead fitting 136.

The cavity 110 has a height 174 that extends from the bottom surface 154 to the top 128 of the container 102. In an embodiment, the lower hole 150 is located along a bottom 25% (e.g., quarter) of the height 174, and the upper hole 138 is located along a top 25% of the height 174. As such, the holes 150, 138 are vertically staggered (e.g., the upper hole 138 is closer to the top 128 than a proximity of the lower hole 150 to the top 128). Placing the lower hole 150 near the bottom surface 154 limits the amount of hardware that is disposed within the cavity 110. For example, if the lower hole 150 were raised higher, an additional length of pipe would be within the cavity 110 relative to the illustrated embodiment. Placing the upper hole 138 near the top 128 may provide easy access to the flow channel 104 for an operator to manually secure the hose 140 (shown in FIG. 2) of the pump device 108 via the connectors 142, 144, without bending down near the ground.

Figure 5:
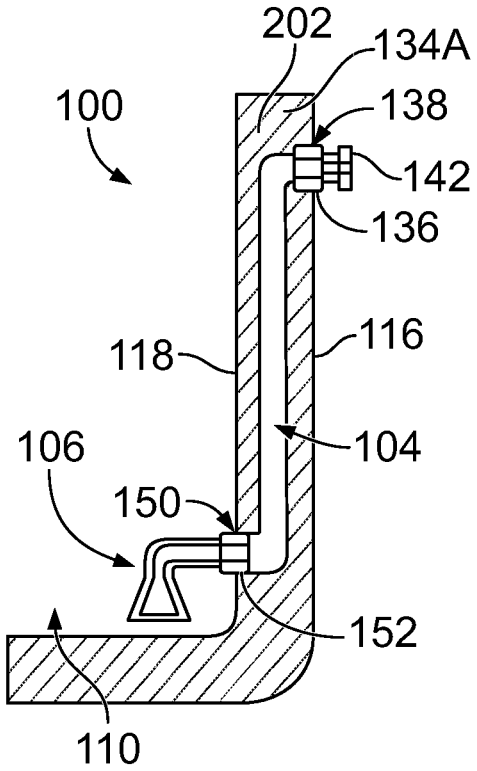
FIG. 5 is a cross-sectional view of a portion of the container assembly according to another embodiment.

FIG. 5 is a cross-sectional view of a portion of the container assembly 100 according to another embodiment. In FIG. 5, the flow channel 104 is defined by the material of the corner section 134A itself. For example, the corner section 134A may have a single wall 202 that has a thickness from the interior surface 118, along the cavity 110, to the exterior surface 116. The wall 202 may be thicker than each of the inner and outer panels 164, 166 shown in FIG. 4. The flow channel 104 may be formed as a shaped and formed passageway (e.g., void) through the thickness of the wall 202. For example, the wall material itself defines the surfaces that define the size and shape of the flow channel 104. The shape of the flow channel 104 may resemble the connected pipes 168, 170, 172 shown in FIG. 4. The flow channel 104 may be formed via extracting material from the wall 202 after formation of the wall 202, such as by drilling through the material of the wall 202. Alternatively, the flow channel 202 may be formed in-situ with the container 102. For example, the corner section 134A may be formed, via additive manufacturing, a molding process, or the like, to inherently include the lower hole 150, the upper hole 138, and the flow channel 104 extending between and fluidly connecting the holes 138, 150. As shown in FIG. 5, forming the flow channel 104 as an integrated, inherent aspect of the container 102 avoids the use of one or more discrete pipes within the corner section 134A. The bulkhead fittings 136, 152 may still be present to assist with connecting the hardware components, such as the header connector 142 and the suction assembly 106, to the corresponding upper and lower holes 138, 150, respectively.

In the illustrated embodiments, the flow channel 104 and the upper and lower holes 138, 150 are disposed along a single corner section 134A of the container 102. In another embodiment, the flow channel 104 and holes 138, 150 may be located along one of the side walls 132 (shown in FIG. 2) instead of a corner section 134. Optionally, the flow channel 104 and holes 138, 150 may span multiple sections of the container 102. For example, the lower hole 150 may be located along a corner section 134, and the upper hole 138 may be located along a side wall 132, with the flow channel 104 traversing through both the corner section 134 and the side wall 132.

Figure 6:
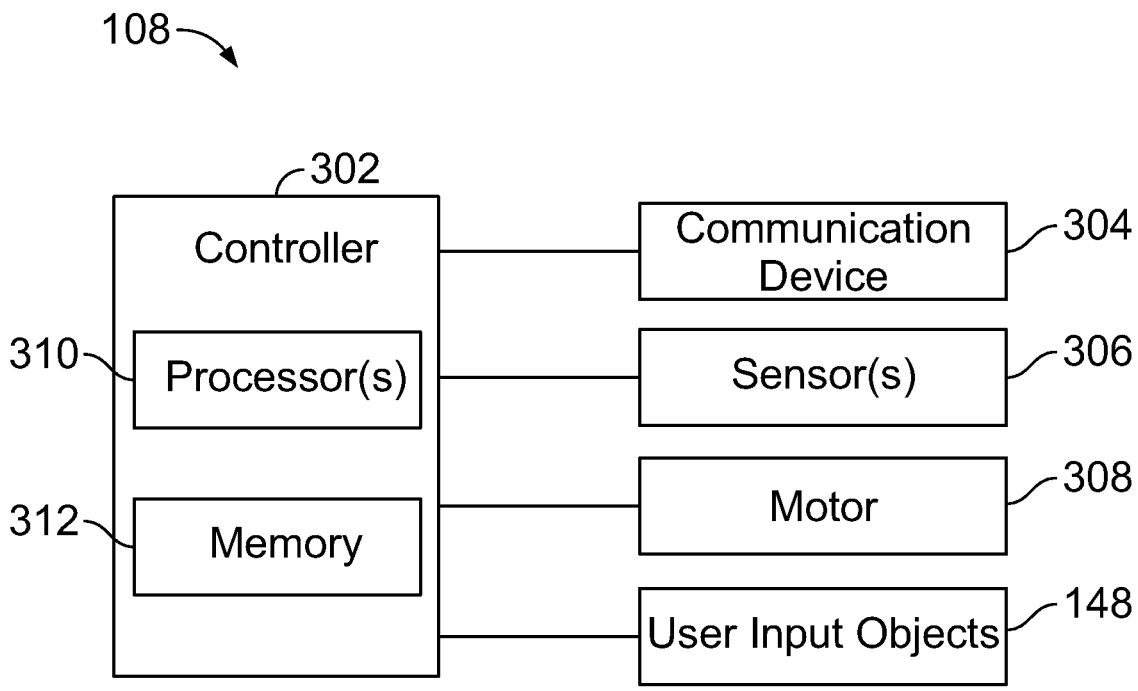
FIG. 6 illustrates a schematic diagram of pump device components of the container assembly system according to an embodiment.

FIG. 6 illustrates a schematic diagram of components of the pump device 108 of the container assembly system 100 according to an embodiment. The pump device 108 may include a controller 302, a communication device 304, one or more sensors 306, a pump motor 308, and the user input objects 148. The controller 302 is communicatively connected to the communication device 304, the sensors 306, the pump motor 308, and the user input objects 148. In an embodiment, all or at least some of these components are housed within the housing 146. Optionally, one or more sensors 306 may be remote from the housing 146, such as mounted to the container 102. The one or more sensors 306 remote from the housing 146 may be positioned to monitor characteristics of the container 102, such as an amount of fluid in the cavity 110.

The controller 302 represents hardware circuitry that includes and/or is connected with one or more processors 310 (e.g., one or more microprocessors, integrated circuits, microcontrollers, field programmable gate arrays, etc.). The controller 302 includes and/or is connected with a tangible and non-transitory computer-readable storage medium, referred to herein as memory 312. The memory 312 may store programmed instructions (e.g., software) that are executed by the one or more processors 310 to perform the operations described herein.

In an embodiment, one or more of the sensors 306 are disposed within the housing 146 for monitoring one or more properties of the fluid 114 that is pumped from the cavity 110 of the container 102. For example, a sensor may be exposed to the fluid 114 received from the hose 140, and may generate sensor data that represents a property of the fluid 114. Suitable properties of the removed fluid may include temperature, flow rate, pH, material composition, and/or the like. The controller 302 receives and analyzes the sensor data. The controller 302 may generate a control signal based on the sensor data. For example, the controller 302 may deactivate (e.g., turn off) or slow down the pump motor 308 upon determining that the flow rate drops below a designated threshold value, based on the sensor data. This automated control action may avoid wasting power by running the pump after the cavity 110 is substantially drained of fluid. Optionally, a sensor 306 may be disposed within the housing 146 for monitoring one or more properties of the pump device 108 itself, such as an operating temperature of the motor 308. The controller 302 may deactivate (e.g., turn off) or slow down the pump motor 308 upon determining that the operating temperature meets or surpasses a designated threshold temperature.

The controller 302 of the pump device 108 may be communicatively connected to one or more sensors 306 outside of the housing 146 via the communication device 304. The communication device 304 may include or represent one or more antennas, one or more transceivers (or discrete transmitters and receivers), and associated circuitry that enables wireless communication. At least one sensor 306 may be a moisture sensor that monitors an amount of the fluid 114 within the cavity 110. The moisture sensor 306 may be mounted on the container 102 or oriented towards the container 102. The moisture sensor 306 may be an ultrasonic sensor, a radar sensor, a camera, a range finder, a magnetic float with associated hall effect sensor, or the like. The moisture sensor 306 may measure a depth of the fluid 114 within the container 102. In an embodiment, once the amount of fluid 114 (e.g., the depth) reaches or exceeds a designated threshold value, the controller 302 may generate at least one control signal to take at least one responsive action. For example, a generated control signal may automatically activate the motor 308 to start removing the fluid 114 from the container 102 through the suction assembly 106 and flow channel 104. Another generated control signal may control the communication device 304 to transmit a notification message to a device used by an operator.

Figure 7:
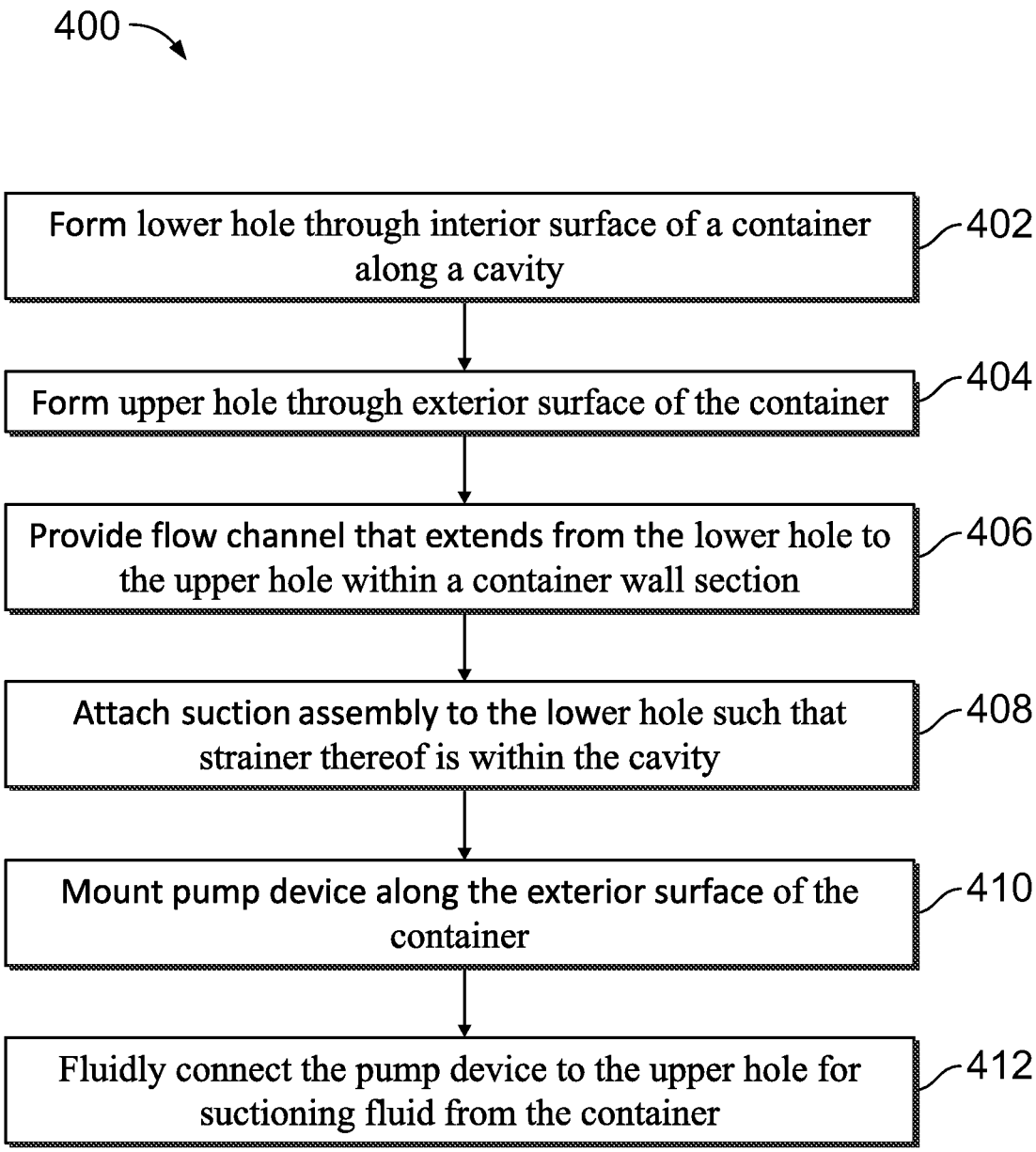
FIG. 7 is a flowchart of a method for assembling a container assembly according to an embodiment.

FIG. 7 is a flowchart of a method 400 for assembling a container assembly 100 according to an embodiment. The method 400, for example, may employ structures or aspects of various embodiments (e.g., systems and/or methods) discussed herein. In various embodiments, certain steps may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion. At step 402, a lower hole 150 is formed through an interior surface 118 of a container 102. The interior surface 118 at least partially defines a cavity 110 of the container 102. The cavity 110 may receive and contain a solid material 124 and a fluid 114. At step 404, an upper hole 138 is formed through an exterior surface 116 of the container 102 outside of the cavity 110. The upper hole 138 is disposed closer than the lower hole 150 to a top 128 of the container 102. Optionally, the lower hole 150 is located along a bottom 25% of a height 174 of the cavity 110, and the upper hole 138 is located along a top 25% of the height 174 of the cavity 110.

At step 406, a flow channel 104 is provided that extends from the lower hole 150 to the upper hole 138 and is disposed within a thickness of a wall section 122 of the container 102. In an embodiment, the flow channel 104 is provided by installing one or more hollow pipes 160 within an internal compartment 162 that is defined along the thickness of the wall section 122. In another embodiment, the flow channel 104 is provided by shaping and forming the flow channel 104 within a material of the wall section 122.

At step 408, a suction assembly 106 is attached to the lower hole 150. The suction assembly 106 is fluidly connected to the flow channel 104. The suction assembly 106 includes a strainer 156 disposed within the cavity 110 of the container 102 for suctioning the fluid 114.

At step 410, a pump device 108 is mounted along the exterior surface 116 of the container 102. At step 412, the pump device 108 is connected to a bulkhead fitting 136 in the upper hole 138. Optionally, connecting the pump device 108 to the bulkhead fitting 136 includes releasably mating a first connector 142, affixed to the bulkhead fitting 136, with a second connector 144 that is affixed to an end of a hose 140 that extends from the pump device 108. Upon mating the connectors 142, 144, the pump device 108 is fluidly connected to the suction assembly 106 through the flow channel 104 and the hose 140. The pump device 108 is operable to generate negative pressure (e.g., a vacuum) to suction the fluid 114 from the cavity 110 of the container 102, isolating the solid material 124.

It should be noted that the particular arrangement of elements (e.g., the number, types, placement, or the like) of the illustrated embodiments described herein may be modified in various alternate embodiments. For example, in various embodiments, different numbers of a given device, unit, or module may be employed. In various embodiments, a different type or types of a given device, unit, or module may be employed. In various embodiments, a number of devices, units, or modules (or aspects thereof) may be combined. In various embodiments, a given device, unit, or module may be divided into plural devices (or sub-devices) or plural units (or sub-units) or plural modules (or sub-modules). In various embodiments, one or more aspects of one or more devices, units, or modules may be shared between devices, units, modules. In various embodiments, a given device, unit, or module may be added or a given device, unit, or module may be omitted.

As used herein, a processor or a processing unit includes processing circuitry configured to perform one or more tasks, functions, or steps, such as those described herein. For instance, the processor may be a logic-based device that performs operations based on instructions stored on a tangible and non-transitory computer readable medium, such as memory. It may be noted that a "processor," as used herein, is not intended to necessarily be limited to a single processor or single logic-based device. For example, the processor may include a single processor (e.g., having one or more cores), multiple discrete processors, one or more application specific integrated circuits (ASICs), and/or one or more field programmable gate arrays (FPGAs). In some embodiments, the processor is an off-the-shelf device that is appropriately programmed or instructed to perform operations, such as the algorithms described herein.

The processor may also be a hard-wired device (e.g., electronic circuitry) that performs the operations based on hard-wired logic that is configured to perform the algorithms described herein. Accordingly, the processor may include one or more ASICs and/or FPGAs. Alternatively, or in addition to the above, the processor may include or may be associated with a tangible and non-transitory memory having stored thereon instructions configured to direct the processor to perform the algorithms described herein.

It is noted that operations performed by the processor (e.g., operations corresponding to the methods/algorithms described herein, or aspects thereof) may be sufficiently complex that the operations may not be performed by a human being within a reasonable time period based on the intended application of the assay system. The processor may be configured to receive signals from the various subsystems and devices of the system or user inputs from the user. The processor may be configured to perform the methods described herein.

Processors may include or be communicatively coupled to memory. In some embodiments, the memory may include non-volatile memory. For example, the memory may be or include read-only memory (ROM), random-access memory (RAM), electrically erasable programmable read-only memory (EEPROM), flash memory, and the like.

In an example embodiment, the processor executes a set of instructions that are stored in one or more storage elements, memories, and the like. Embodiments include non-transitory computer-readable media that include set of instructions for performing or executing one or more processes set forth herein. Non-transitory computer readable media may include all computer-readable media, except for transitory propagating signals per se. The non-transitory computer readable media may include generally any tangible computer-readable medium including, for example, persistent memory such as magnetic and/or optical disks, ROM, and PROM and volatile memory such as RAM. The computer-readable medium may store instructions for execution by one or more processors.

The set of instructions may include various commands that instruct the system to perform specific operations such as the methods and processes of the various embodiments described herein. The set of instructions may be in the form of a software program. As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein. Instead, the use of "configured to" as used herein denotes structural adaptations or characteristics, and denotes structural requirements of any structure, limitation, or element that is described as being "configured to" perform the task or operation. For example, a processing unit, processor, or computer that is "configured to" perform a task or operation may be understood as being particularly structured to perform the task or operation (e.g., having one or more programs or instructions stored thereon or used in conjunction therewith tailored or intended to perform the task or operation, and/or having an arrangement of processing circuitry tailored or intended to perform the task or operation). For the purposes of clarity and the avoidance of doubt, a general-purpose computer (which may become "configured to" perform the task or operation if appropriately programmed) is not "configured to" perform a task or operation unless or until specifically programmed or structurally modified to perform the task or operation.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are example embodiments. Many other embodiments will be apparent to those of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general-purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A container assembly comprising:

a container that defines a cavity configured to receive a fluid therein, the container including an interior surface along the cavity and an exterior surface outside of the cavity, the interior surface defining a lower hole, the exterior surface defining an upper hole that is disposed closer than the lower hole to a top of the container;

a flow channel extending from the lower hole to the upper hole and disposed within a thickness of one or more wall sections of the container; and a suction assembly attached to the lower hole and fluidly connected to the flow channel, the suction assembly including a strainer disposed within the cavity of the container for suctioning the fluid from the container.

2. The container assembly of claim 1, wherein the flow channel is defined by one or more hollow pipes disposed within an internal compartment of the one or more wall sections.

3. The container assembly of claim 2, wherein a first wall section of the one or more wall sections includes an inner panel and an outer panel and the internal compartment is defined between the inner and outer panels, wherein the lower hole extends through the inner panel and the upper hole extends through the outer panel.

4. The container assembly of claim 2, wherein the one or more hollow pipes within the internal compartment include a first elbow joint connected to the lower hole, a second elbow joint connected to the upper hole, and a linear pipe that is connected to both the first and second elbow joints.

5. The container assembly of claim 1, wherein the flow channel is defined by a material of the one or more wall sections itself.

6. The container assembly of claim 1, wherein the one or more wall sections of the container include multiple side walls and multiple corner sections that connect the side walls together, wherein the flow channel is located within one of the corner sections.

7. The container assembly of claim 1, further comprising a bulkhead fitting mounted to the upper hole and a first connector affixed to the bulkhead fitting, the first connector configured to releasably connect to a mating connector for coupling a pump device to the suction assembly via the flow channel.

8. The container assembly of claim 1, further comprising a bulkhead fitting mounted to the upper hole, a pump device mounted to the container along the exterior surface of the container, and a hose extending from the bulkhead fitting to the pump device to fluidly connect the pump device to the suction assembly via the flow channel and the hose.

9. The container assembly of claim 1, wherein the container is a plastic tote for receiving into the cavity at least one of waste material or recyclable material stemming from an industrial process.

10. The container assembly of claim 1, wherein the cavity of the container has a height that extends from a bottom surface to the top of the container, wherein the lower hole is located along a bottom 25% of the height and the upper hole is located along a top 25% of the height.

11. A method for assembling a container assembly, the method comprising:

forming a lower hole through an interior surface of a container, the interior surface at least partially defining a cavity of the container configured to receive a fluid therein;

forming an upper hole through an exterior surface of the container outside of the cavity, the upper hole disposed closer than the lower hole to a top of the container;

providing a flow channel that extends from the lower hole to the upper hole and is disposed within a thickness of a wall section of the container; and attaching a suction assembly to the lower hole, the suction assembly fluidly connected to the flow channel and including a strainer disposed within the cavity of the container for suctioning the fluid from the container.

12. The method of claim 11, wherein the flow channel is provided by installing one or more hollow pipes within an internal compartment that is defined along the thickness of the wall section.

13. The method of claim 11, wherein the flow channel is provided by shaping and forming the flow channel within a material of the wall section.

14. The method of claim 11, further comprising mounting a pump device along the exterior surface of the container and connecting the pump device to a bulkhead fitting in the upper hole.

15. The method of claim 14, wherein connecting the pump device to the bulkhead fitting comprises releasably mating a first connector, affixed to the bulkhead fitting, with a second connector that is affixed to an end of a hose that extends from the pump device.

16. The method of claim 11, wherein forming the lower hole and the upper hole comprises locating the lower hole along a bottom 25% of a height of the cavity and locating the upper hole along a top 25% of the height of the cavity.

17. A container assembly comprising:

a container that defines a cavity configured to receive a fluid therein, the container including a wall section that has an inner panel along the cavity and an outer panel outside of the cavity, the inner panel spaced apart from the outer panel to define an internal compartment within a thickness of the wall section, the inner panel defining a lower hole therethrough, the exterior surface defining an upper hole therethrough, the upper hole disposed closer than the lower hole to a top of the container;

one or more hollow pipes disposed within the internal compartment of the wall section, the one or more hollow pipes defining a flow channel from the lower hole to the upper hole; and a suction assembly attached to the lower hole and fluidly connected to the one or more hollow pipes, the suction assembly including a strainer disposed within the cavity of the container for suctioning the fluid from the container.

18. The container assembly of claim 17, wherein the wall section is a corner section that is disposed between and connects two side walls of the container.

19. The container assembly of claim 17, wherein the one or more hollow pipes within the internal compartment include a first elbow joint connected to the lower hole, a second elbow joint connected to the upper hole, and a linear pipe that is connected to both the first and second elbow joints.

20. The container assembly of claim 17, further comprising a bulkhead fitting mounted to the upper hole, a pump device mounted along the exterior surface of the container, and a hose that extends from the pump device to the bulkhead fitting and fluidly connects the pump device to the upper hole.

* * * * *